United States Patent [19]

Fratty

[11] 4,308,574

[45] Dec. 29, 1981

[54] AUTOMOBILE HEADLIGHT WITH REDUCED HEATING OF THE COVER GLASS

[75] Inventor: Hector Fratty, Boulogne, France

[73] Assignee: Cibie Projecteurs, Bobigny, France

[21] Appl. No.: 967,664

[22] Filed: Dec. 8, 1978

[30] Foreign Application Priority Data

Dec. 29, 1977 [FR] France ..... 77 39642

[51] Int. Cl.[3] ..... F21Y 7/00

[52] U.S. Cl. ..... 362/303; 362/346

[58] Field of Search ..... 362/61, 64, 80, 303, 362/396, 398, 864

[56] References Cited

U.S. PATENT DOCUMENTS

| | | | |
|---|---|---|---|
| Re. 17,825 | 10/1930 | Linton et al. | 362/348 |
| 1,825,084 | 9/1931 | Michel | 362/348 |
| 1,976,163 | 10/1934 | Exelmans | 362/348 X |
| 2,199,014 | 4/1940 | Stitt | 362/303 X |
| 2,499,555 | 3/1950 | Wronkowski | 362/61 X |
| 2,999,924 | 9/1961 | Mottier et al. | 362/61 X |
| 3,184,591 | 5/1965 | Gibie | 362/346 X |
| 3,486,019 | 12/1969 | Bryant et al. | 362/303 X |
| 3,754,135 | 8/1973 | Hulbert, Jr. | 362/303 X |
| 3,818,210 | 6/1974 | Pitkjaan | 362/61 |
| 4,149,227 | 4/1979 | Dorman | 362/804 X |

*Primary Examiner*—Peter A. Nelson

*Attorney, Agent, or Firm*—Alan H. Levine

[57] ABSTRACT

The invention relates to an automobile headlight comprising a light source, a reflector and a cover glass, wherein zones of the reflector giving rise to a concentration of the rays reflected on the cover glass are concealed, thus minimizing the heating of the glass, without substantially disturbing the luminous efficacy.

6 Claims, 6 Drawing Figures

AUTOMOBILE HEADLIGHT WITH REDUCED HEATING OF THE COVER GLASS

The present invention relates to automobile headlights comprising a reflector mirror cooperating with at least one source of light and a cover glass ensuring the seal of the headlight and serving, in the majority of cases, to influence the luminous distribution of the beam reflected by the mirror.

It is to be understood that the term "headlight" as used here covers both the sealed beam units in which the cover glass is fixed at the front of the reflector and the more complex systems in which the reflector is housed in a casing (which may itself be a simple housing made in the bodywork of an automobile), the cover glass being mounted on this casing.

In the majority of automobile headlights, and in a manner which varies directly as a function of the light power emitted, certain zones of the cover glass are taken to relatively high temperatures which may reach 150° C. during normal operation. For a cover glass made of plastics material, such heating causes a softening and consequently deflections and deformations of certain parts of the glass. For a cover made of glass, such heating brings about the breakage of the glass if water is suddenly projected thereon.

It is an object of the invention to eliminate these drawbacks by providing means for reducing such a heating of the cover glass.

The gist of the invention lies in the unexpected observation that the heating of the glass essentially comes from an excessive concentration of the beam returned by the reflector (comprising both the visible rays of a wave length of between 0.4 and 0.7$\mu$ and the infrared rays of a wave length higher than 0.7$\mu$) at the glass level; at the points of concentration, the infrared rays of the beam provoke a local heating of the glass. On the basis of this observation, the gist of the invention resides in the fact that the reflector is modified with a view to eliminating the radiation coming from certain selected zones which produce the concentration, without diminishing the qualities of illumination of all the beam of the headlight.

The invention thus proposes a headlight characterised by the concealing or occultation of certain zones of its reflector corresponding to the zones of maximum heating of the glass.

The present invention finds a particularly satisfactory application in the case of heating provoked in the vicinity of the centre of the glass by a beam of the dipped beam type. In this case, a ring sector in the upper part of the rear of the reflector is concealed or occulted.

The invention will be more readily understood on reading the following description with reference to the accompanying drawings, in which.

Figure 4A:
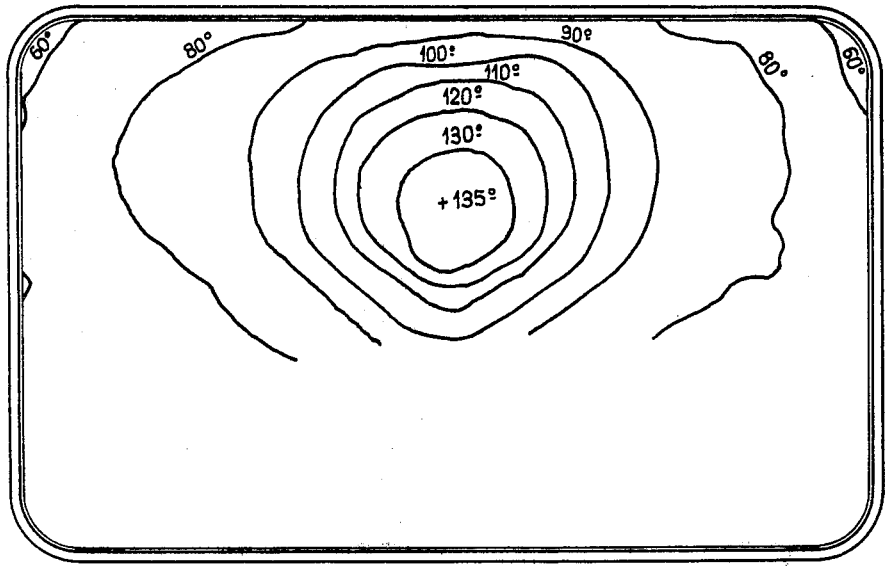
Figure 4B:
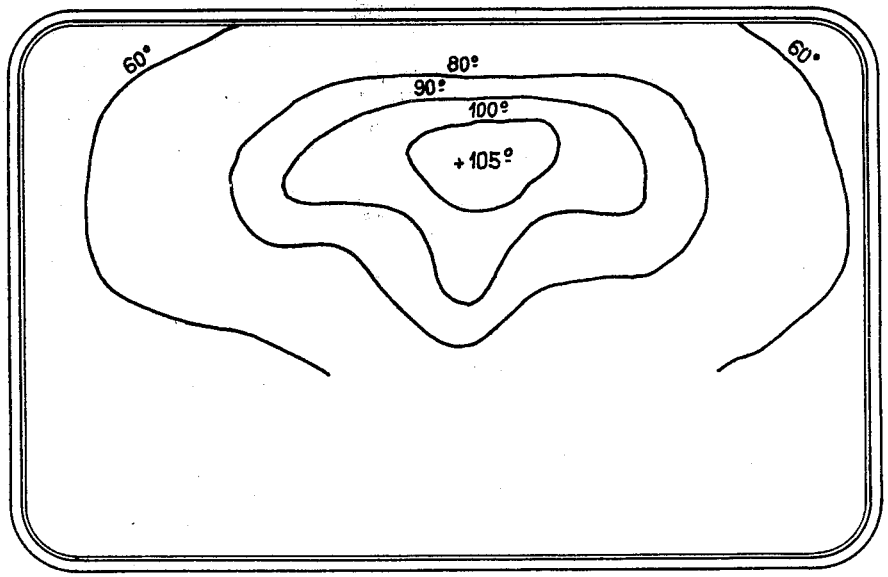
Figure 5:
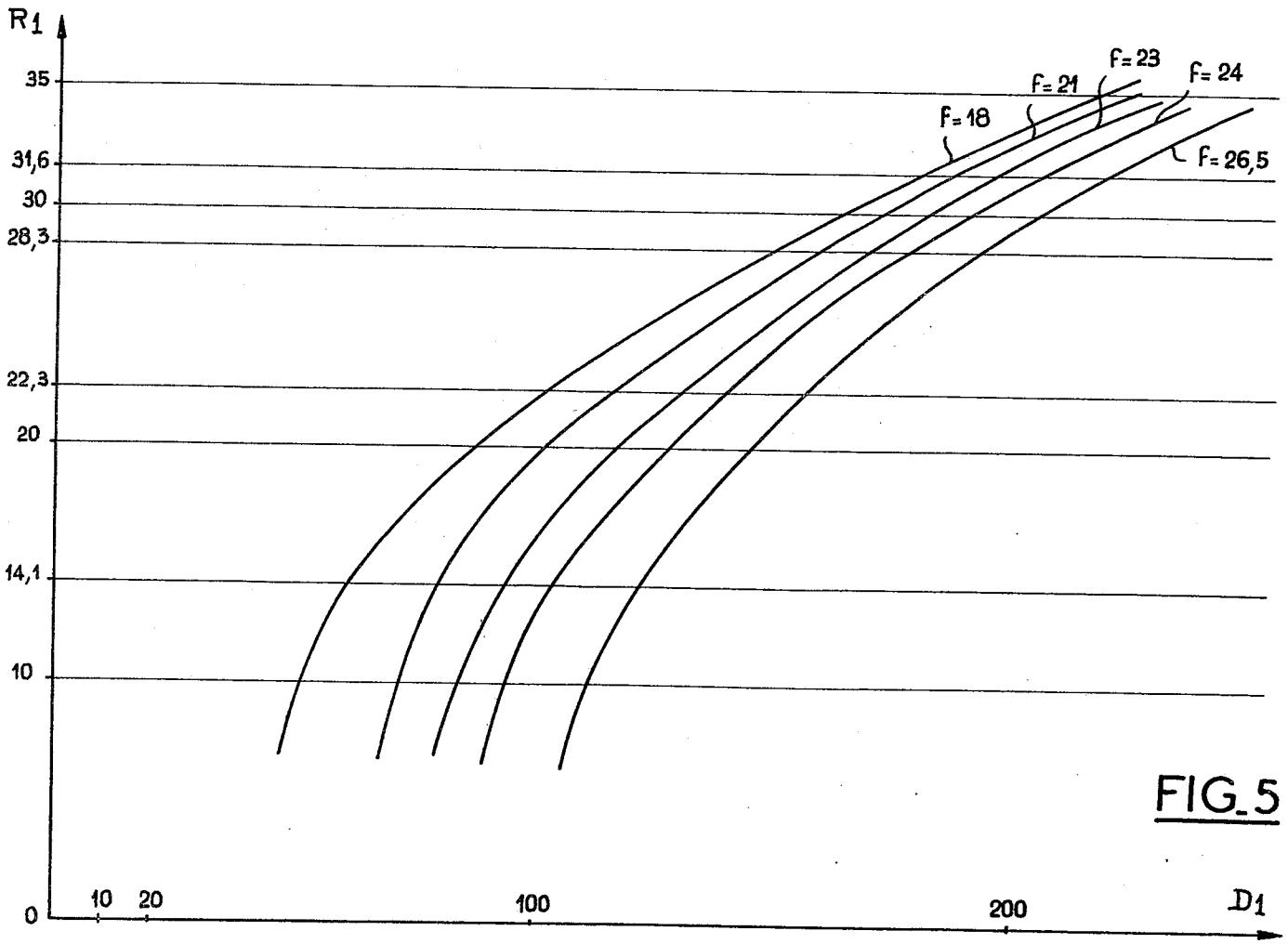

FIG. 4*a* and 4*b* show the isothermal curves of two similar headlights, the first being in accordance with the prior art, the second modified according to the invention FIG. 5 graphically shows the modalities of the modifications according to the invention, for a whole range of dipped beam headlights.

Figure 1:
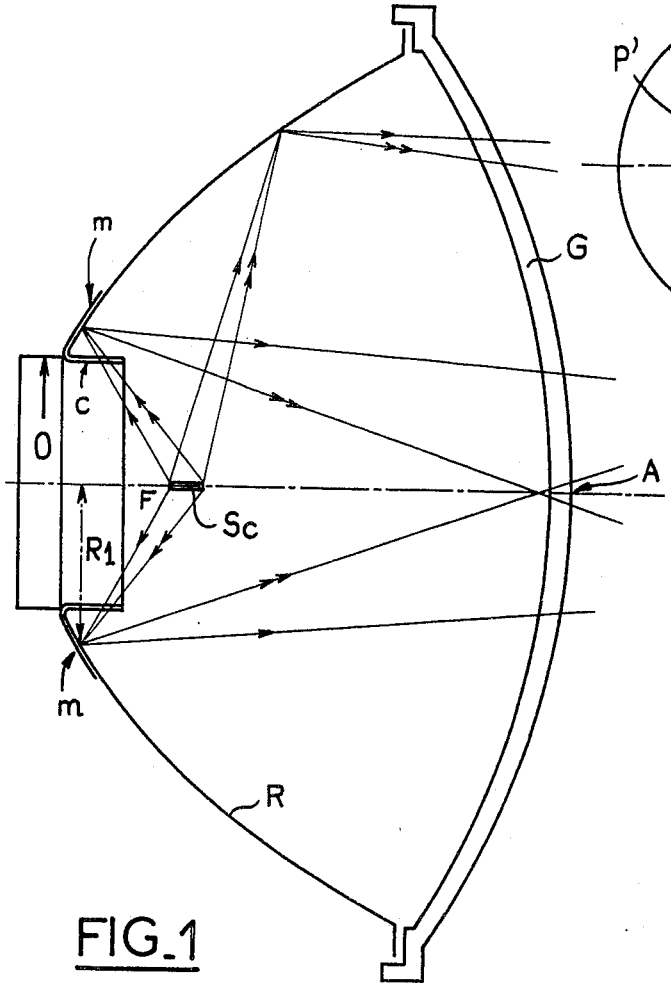
FIG. 1 shows a horizontal section through a sealed beam unit provided with a light source for dipped beam illumination, according to the present invention.
Figure 2:
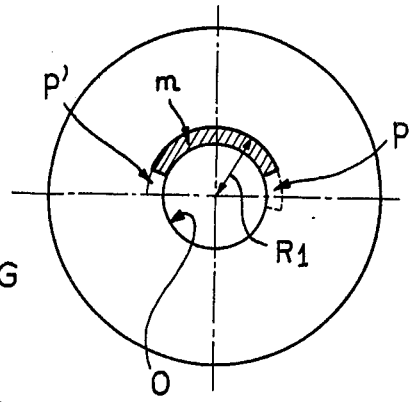
FIG. 2 is a front view of the reflector mirror of such a headlight.

Referring now to the drawings, the headlight of FIG. 1 comprises, in manner known per se, a reflector R of focus F of which the rear is provided with a central opening O serving for the assembly of a lamp. For dipped beam illumination, a light source $S_c$ is disposed in front of the focus F. The reflector R is closed by a cover glass G which serves both as seal for the system and for the lateral dispersion of the light flux issuing from $S_c$ and returned by reflector R.

Figure 3:
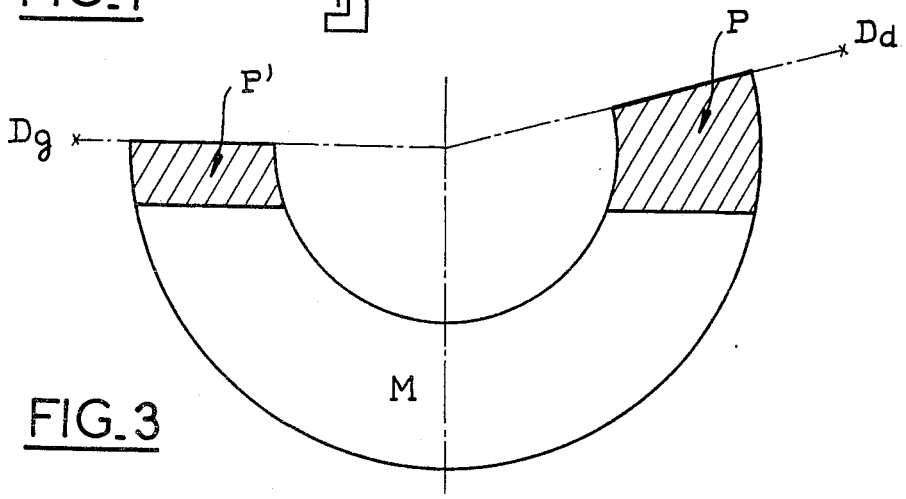
FIG. 3 shows on a screen the illumination obtained by the zone of the mirror which contributes considerably to the heating of the glass.

In manner known per se, the dipped beam returned by the reflector R is slightly convergent. On the other hand, cut-off means are provided so as to limit the dipped beam in the lower part of the two half-planes of cut which are projected ($D_g$ and $D_d$) on a screen, as shown in FIG. 3. The cut-off means may for example be a screen (not shown) surrounding the light source filament $S_c$ and of which the edges produce the limits of cut $D_g$ and $D_d$.

A conventional automobile headlight of the above type shows a very considerable concentration of the light rays in a central zone A located slightly above the centre of its cover glass. The light rays comprise both the visible radiation and infrared radiation, and a prejudicial heating is produced thereby, which the invention aims at reducing.

The gist of the invention is to limit the concentration of rays at A without substantially disturbing the overall illumination given by the dipped beam.

To this end, according to the invention, the zone which contributes largely to the heating of point A, i.e. a small zone m extending in a ring around the opening O in the upper part of the rear of the reflector R is concealed. The zone m extends parallel to the edge of the opening O, surmounting at its two ends zones p and p' forming part of the same geometric ring.

FIG. 3 shows the projection of zones m, p, p' into M, P, P'.

The concealing of zone m may be effected by a series of means known per se; the reflecting coating may be eliminated or it may be rendered inoperative by being coated with black.

An equivalent solution resides in the occultation of the zone m with the aid of a screen C to avoid rays issuing from $S_c$ striking zone m. Such a screen is advantageously made of metal to evacuate to outside the headlight the calorific energy of the intercepted rays.

In all cases, such a zone, according to the invention, does not participate in the formation of the beam.

This results in a reduced heating in zone A of the glass, but, due to the existence of the reflecting zones p and p' which project (cf. FIG. 3) immediately below the left-hand and right-hand limits of cut $D_g$ and $D_d$, the dipped beam is not substantially changed for the user (it is known, in fact, and the standards specify this, that the quality of a dipped beam depends especially on a good illumination immediately below the cut).

FIGS. 4*a* and 4*b* illustrate the improvements obtained due to the present invention.

They both represent the rectangular cover glass of a dipped beam headlight comprising a parabolic mirror of horizontal diameter 150 mm and height 100 mm. It is provided with a colourless lamp of H4 type, supplied with a test voltage of 13.5 volts. In permanent operation, the ambient temperature being 20° C., the isothermal curves of the cover glass shown in the Figures are obtained.

In the case of FIG. 4*a*, the headlight has not been equipped according to the invention. Considerable heating is observed, with the hottest point at the centre, at 135° C.

FIG. 4*b* concerns the same headlight, provided according to the invention (zone m concealed). Very considerable changes in the isothermal curves are noted, the temperature of the hottest point at the centre dropping to 105° C.

The above results clearly illustrate the effectiveness of the invention.

The arrangement of the zone m generally depends on the parameters of the headlight and on the position of the cover glass G.

If $D_1$ designates the distance from the focus F of the reflector to the centre of the cover glass (distance F−A, FIG. 1) and $R_1$ the distance from the centre of zone m to the optical axis of the headlight, the diagram of FIG. 5 generally makes it possible to choose, for the different focal distances f of the reflector R, the distance $R_1$ to be chosen as a function of distance $D_1$. All the values are given in millimeters. With the curve of FIG. 1, the position of zone m is defined for all types of dipped beam headlights.

The determination of the graph of FIG. 5 is effected without difficulty by simple geometrical optical calculations (it is question of locating the zone of convergence A).

It will further be noted that the invention is applied to any type of headlight and that, in addition ot the theoretical approach described hereinabove, for determining the zone m, the man skilled in the art also has an equivalent rule of thumb approach at his disposal since it suffices for him to determine the hottest zone on the cover glass itself in order thereafter to conceal or occult the corresponding zone of the reflector.

The invention is not limited to the particular embodiment described (dipped beam headlight), but extends to all variants within its scope.

I claim:

1. An automobile headlight comprising:

(a) a reflector having a rear central opening and a focus in front of that opening;

(b) a transparent cover closing the front of the reflector;

(c) a light source located in front of the reflector focus so that the rays from the light source which are reflected by the reflector tend to converge toward the cover, thereby heating the cover, and the headlight having a cut-off plane for providing a dipped beam; and (d) the reflector having a region which does not reflect direct rays from the light source toward the cover, said region being adjacent to and radially outward of the rear central opening of the reflector, and said reflector region stopping short of preventing reflection of dipped beam rays from the reflector in the vicinity of the cut-off plane;

whereby the heating effect of the reflected rays on the cover is reduced.

2. An automobile headlight as defined in claim 1 wherein said reflector region has an arcuate shape at least partially surrounding the reflector opening.

3. An automobile headlight as defined in claim 1 wherein said reflector region is non-reflecting.

4. An automobile headlight as defined in claim 1 wherein said reflector region carries a black coating.

5. An automobile headlight as defined in claim 1 including a screen for preventing direct rays from the light source from reaching said reflector region.

6. An automobile headlight as defined in claim 5 wherein the screen is metallic and includes a portion extending externally of the reflector, for conducting heat, generated by the rays from the light source, to the exterior of the headlight.

* * * * *